US007874274B2

(12) United States Patent
Strauss

(10) Patent No.: US 7,874,274 B2
(45) Date of Patent: Jan. 25, 2011

(54) APPARATUS FOR THE VARIABLE SETTING OF CONTROL TIMES OF GAS-EXCHANGE VALVES OF AN INTERNAL COMBUSTION ENGINE

(75) Inventor: Andreas Strauss, Forchheim (DE)

(73) Assignee: Schaffler Technologies GmbH & Co. KG, Herzogenaurach (DE)

( * ) Notice: Subject to any disclaimer, the term of this patent is extended or adjusted under 35 U.S.C. 154(b) by 330 days.

(21) Appl. No.: 12/199,899

(22) Filed: Aug. 28, 2008

(65) Prior Publication Data

US 2009/0056656 A1 Mar. 5, 2009

(30) Foreign Application Priority Data

Aug. 31, 2007 (DE) ..... 10 2007 041 552

(51) Int. Cl.
*F01L 1/34* (2006.01)

(52) U.S. Cl. ..... 123/90.17; 123/90.12; 123/90.15; 464/160

(58) Field of Classification Search ..... 123/90.12, 123/90.13, 90.15, 90.16, 90.17, 90.18; 464/1, 464/2, 160
See application file for complete search history.

(56) References Cited

U.S. PATENT DOCUMENTS 5,775,279 A 7/1998 Ogawa et al.
6,516,763 B1 * 2/2003 Strauss ..... 123/90.17

FOREIGN PATENT DOCUMENTS

EP 1025343 7/2003

* cited by examiner

*Primary Examiner*—Ching Chang
(74) *Attorney, Agent, or Firm*—Volpe and Koenig, P.C.

(57) ABSTRACT

An apparatus (10) for the variable setting of control times of gas-exchange valves (9*a, b*) of an internal combustion engine (1) is provided and includes a drive element (22), a driven element (23), at least one pressure chamber (35, 36), a pressurized medium system (37), and a pressure storage device (43). The pressure chamber (35, 36) and the pressure storage device (43) communicate with the pressurized medium system (37), and a phase position between the driven element (23) and the drive element (22) can be changed by supplying pressurized medium to or discharging pressurized medium from the pressure chamber (35, 36) by the pressurized medium system (37).

8 Claims, 5 Drawing Sheets

APPARATUS FOR THE VARIABLE SETTING OF CONTROL TIMES OF GAS-EXCHANGE VALVES OF AN INTERNAL COMBUSTION ENGINE

CROSS-REFERENCE TO RELATED APPLICATIONS

This application claims the benefit of German Application DE 10 2007 041 552, filed Aug. 31, 2007, which is incorporated here by reference as if fully set forth.

BACKGROUND

The invention relates to an apparatus for the variable setting of control times of gas-exchange valves of an internal combustion engine with a drive element, a driven element, at least one pressure chamber, a pressurized medium system, and a pressure storage system, wherein the pressure chamber and the pressure storage system communicate with the pressurized medium system, wherein a phase position between the driven element and the drive element can be changed through the supply of pressurized medium to or the discharge of pressurized medium from the pressure chamber via the pressurized medium system.

In modern internal combustion engines, apparatuses for the variable setting of control times of gas-exchange valves are used to be able to variably shape the phase relation between the crankshaft and camshaft in a defined angular range, between a maximum advanced and a maximum retarded position. For this purpose, the device is integrated into a drive train, by which torque is transmitted from the crankshaft to the camshaft. This drive train can be realized, for example, as a belt, chain, or gearwheel drive.

Such a device is known, for example, from EP 1 025 343 B1. The apparatus comprises two rotors that can rotate relative to each other, wherein an outer rotor is in driven connection with the crankshaft and the inner rotor is locked in rotation with the camshaft. The apparatus comprises several pressure spaces, wherein each of the pressure spaces is divided by a vane into two counteracting pressure chambers. Through the supply of pressurized medium to or the discharge of pressurized medium from the pressure chambers, the vanes are shifted within the pressure spaces, which generates a targeted rotation of the rotors relative to each other and thus the camshaft relative to the crankshaft.

The supply of pressurized medium to or the discharge of pressure from the pressure chambers is controlled by a pressurized medium system, which comprises a pressurized medium pump, a tank, a control valve, and several pressurized medium lines. Here, a pressurized medium line connects the pressurized medium pump to the control valve. Each pressurized medium line connects one of the working connections of the control valve to the pressure chambers.

To guarantee the function of the apparatus, the pressure in the pressurized medium system must exceed a certain value in each operating phase of the internal combustion engine. This is especially critical in the idling phases of the internal combustion engine, because the pressurized medium pump is driven by the crankshaft and thus the system pressure increases with the rotational speed of the internal combustion engine. The system pressure provided by the pressurized medium pump is furthermore dependent on the pressurized medium temperature, wherein the system pressure decreases for increasing temperature. Thus, the pressurized medium pump must be designed such that this makes available sufficient system pressure under the least favorable conditions, in order to guarantee adjustment of the phase position of the inner rotor relative to the outer rotor.

If, during an idling phase of the internal combustion engine, an adjustment request is made on the device, then at the beginning of the adjustment process, the system pressure falls further due to the higher pressurized medium need. This can have the result that the adjustment process can be performed only with an adjustment speed that is too low. Thus, the performance of the internal combustion engine is reduced, wherein it can produce, for example, losses in the provided torque and increased raw-material emissions.

In addition, in U.S. Pat. No. 5,775,279, another such device is disclosed, in which a pressure storage device is provided, which communicates with a pressurized medium line, which connects the pressurized medium pump to the control valve. This pressure storage device is used to move the inner rotor relative to the outer rotor against the alternating and dragging moments of the camshaft into a base position when the internal combustion engine is turned off. This adjustment, which is to be performed just by the pressurized medium stored in the pressure storage device, requires a high pressure in the pressure storage device. The pressure storage device is consequently designed in such a way that the pressure, at which the pressure storage device is completely full, is significantly above the pressure that prevails during the idling of the internal combustion engine in the pressurized medium system. If the rpm's of the internal combustion engine decrease, then the pressure storage device empties before the idling rotational speed is reached. Thus, the pressurized medium volume that is available and that can be retrieved in the idling phase, is too low to guarantee an adjustment into these phases.

SUMMARY

The invention is based on the desire to provide a device for the variable setting of control times of the gas-exchange valves of an internal combustion engine, wherein a functionally reliable, uninterrupted adjustment of the control times is guaranteed in each operating phase of the internal combustion engine, without having to use larger dimensions for the pressurized medium pump of the internal combustion engine.

In accordance with the invention, the pressure storage device is designed in such a way that its minimum fill pressure is less than the pressure within the pressurized medium system for the idling rotational speed of the internal combustion engine.

Here, the minimum fill pressure is understood to be that system pressure, at which the pressurized medium volume within the pressure storage device reaches its maximum. The pressure within the pressurized medium system at the idling rotational speed of the internal combustion engine is to be applied to the pressure that prevails when the internal combustion engine has reached the operating temperature.

The apparatus is constructed, for example, as in the state of the art, in the form of a vane-wheel adjuster and has a drive element (outer rotor), which is driven, for example, by a traction element (chain or belt) or gearwheel drive from a crankshaft of the internal combustion engine. In addition, a driven element (inner rotor) is provided, which has a constant phase position relative to a camshaft and which is locked in rotation to this camshaft, for example, by a friction-fit, force-fit, or material-fit connection or screw connection. Within the apparatus, several pressure spaces are formed, which are each divided by a vane into two counteracting pressure chambers. The vanes are connected to the driven element or to the drive element. The pressure chambers can be connected by a control valve to a pressurized medium pump or to a tank. Through the supply of pressurized medium to or the discharge of pressurized medium from the pressure chambers, the vanes are shifted within the pressure spaces, by which the relative phase position of the driven element can be variably set relative to the drive element and thus the camshaft relative to the crankshaft.

Alternatively, other embodiments of an apparatus could also be provided, for example, apparatuses with an axial adjustment construction, in which a piston that can be shifted in the axial direction by pressurized medium interacts via spiral gearing with the driven element and the drive element. Also conceivable is an embodiment, in which only one of the counteracting pressure chambers is charged with pressurized medium, while an adjustment of the phase position in the other direction is created by one or more spring elements.

The apparatus has a locking mechanism, which allows a mechanical, for example, positive-fit coupling of the driven element to the drive element. Here, the locking mechanism can be made from one or more rotational angle limiting apparatuses. The rotational angle limiting apparatuses can assume a locked state, in which the possible phase positions of the driven element relative to the drive element are limited to an angular interval, which is smaller than the maximum angular interval permitted by the apparatus. Here, the rotational angle limiting apparatus can limit the permitted phase range to a defined angular interval or a defined angle (with play). Through pressurizing the rotational angle limiting apparatuses with pressurized medium, these can be transferred into an unlocked state, in which the entire angular interval is made available to the apparatus.

A conceivable embodiment of a rotational angle limiting apparatus is made from an engagement element, e.g., a pin or a plate, and a receptacle for the engagement element. The receptacle can be constructed, for example, as an elongated groove along a section of a circular line or as a recess, which is adapted to the engagement element. Also conceivable is a construction in the form of a stepped connection rod, in which a recess adapted to the engagement element is also constructed within an elongated groove.

The receptacle of the rotational angle limiting apparatus can be pressurized with pressurized medium via a control line, for example, with one of the pressure chambers or via the control valve and additional pressurized medium lines.

In addition, a pressure storage device is provided, which communicates with the hydraulic medium system, in particular, via one of the pressurized medium lines. Here, the pressure storage device can open into a pressurized medium line, which connects the pressurized medium pump to the control valve or the control valve to the pressure chambers.

The pressure storage device can be constructed, for example, as a spring storage device, piston storage device, membrane storage device, bubble storage device, or plate-spring storage device.

If the response pressure of the pressure storage device (pressure, at which the filling of the pressure storage device starts) is selected to be smaller than the pressure within the pressurized medium system at the idling rotational speed of the internal combustion engine, then during the operation of the internal combustion engine, the pressure storage device is filled. If the minimum fill pressure of the pressure storage device is also selected to be smaller than the system pressure at the idling rotational speed, then the pressure storage device itself is completely filled with pressurized medium at the idling rotational speed. Now, an adjustment request to the apparatus decreases the system pressure of the pressurized medium system below the minimum fill pressure and the pressure storage device begins to empty. Thus, the pressure level in the pressurized medium system of the device is held at a higher pressure level and an additional quantity of pressurized medium is provided. Thus, the pressurized medium pump can be designed in such a way that its output capacity and output pressure at the idling rotational speed of the internal combustion engine for the presence of the operating temperature are just adequate for keeping an angular position. For an adjustment request, the pressure storage device supports the adjustment. Thus, the function of the apparatus can be made reliable, without having to make the dimensions of the pressurized medium pump larger.

In one refinement of the invention it is provided that the apparatus has a rotational angle limiting device, which has a receptacle and at least one engagement element pressurized in the direction of the receptacle, wherein the rotational angle limiting apparatus, in a locked state, in which the engagement element engages in the receptacle, limits the phase position of the driven element relative to the drive element at least to an angular range, wherein the rotational angle limiting device can be transferred through pressurized medium charging of the receptacle into an unlocked state and wherein the minimum response pressure of the pressure storage device is larger than the minimum response pressure of the rotational angle limiting device.

During the operating phases, in which the system pressure of the pressurized medium system is below the minimum response pressure of the rotational angle limiting apparatuses, for example, during the start-up phase of the internal combustion engine, the rotational angle limiting apparatuses are located in the locked state. Thus, there is a positive-fit, rotationally locked connection between the driven element and the drive element, and changes to the phase position of the components relative to each other are not provided. In these phases, support of the pressurized medium system by the pressure storage device is not necessary. The phase position can be changed only when the system pressure is sufficient to transfer the rotational angle limiting apparatuses into an unlocked state. If the minimum response pressure of the pressure storage device is selected in such a way that this is higher than the minimum response pressure of the rotational angle limiting apparatuses, the entire fill volume of the pressure storage device is made available to the system within a narrow pressure band underneath the pressure that prevails in the pressurized medium system at idling of the internal combustion engine. Thus, for an adjustment request at the idling rotational speed, which is oriented to the apparatus, a sudden and complete emptying of the pressure storage space is realized. This guarantees a prompt and complete reaction of the device to the adjustment request.

In one refinement of the invention, it can be provided that the pressurized medium system has a control valve, a pressurized medium pump, and several pressurized medium lines, wherein the control valve has at least one supply connection and at least one work connection, wherein a first pressurized medium line connects the work connection to the pressure chamber, wherein another pressurized medium line connects the pressurized medium pump to the supply connection, and wherein the pressure storage device opens into the other pressurized medium line upstream of the control valve. Thus, the pressure storage device communicates in each operating phase of the internal combustion engine directly with the pressurized medium pump. In addition, adjustment demands both in the direction of advanced and also retarded control times can be realized. For this purpose, only the suitable control position of the control valve must be set.

In addition, it can be provided that a non-return valve, which permits, at this point, a pressurized medium flow only in the direction of the opening position of the pressure storage device, is arranged in the pressurized medium system upstream of the position, at which the pressure storage device opens into the pressurized medium system. Therefore, it is prevented that the pressurized medium delivered from the pressure storage device flows back to the pressurized medium pump. Thus, the entire pressurized medium volume of the pressure storage device is available for the phase adjustment.

In one embodiment of the invention, it is provided that the pressure storage device is arranged within a camshaft. This is especially advantageous in applications, in which the camshaft has a hollow construction. Thus, the pressure storage device can be used, without increasing the spatial requirements of the internal combustion engine. In addition, in this way a minimum distance is realized between the pressure storage device and the apparatus and thus the response behavior is improved.

Advantageously, the volume of the pressure storage device corresponds at least to the volume that must be supplied to the apparatus, in order to allow an adjustment that corresponds to a maximum permissible phase difference at a constant rotational speed. Thus it is guaranteed that sufficient pressurized medium is made available for adjustment during adjustment at the idling rotational speed.

In one embodiment of the invention, the minimum fill pressure of the pressure storage device is selected to be less than 1 bar. In addition, the minimum response pressure of the pressure storage device is selected to be greater than 0.3 bar.

BRIEF DESCRIPTION OF THE SEVERAL VIEWS OF THE DRAWINGS

Additional features of the invention emerge from the following description and from the drawings, in which an embodiment of the invention is shown simplified. Shown are.

DETAILED DESCRIPTION OF THE PREFERRED EMBODIMENTS

Figure 1:
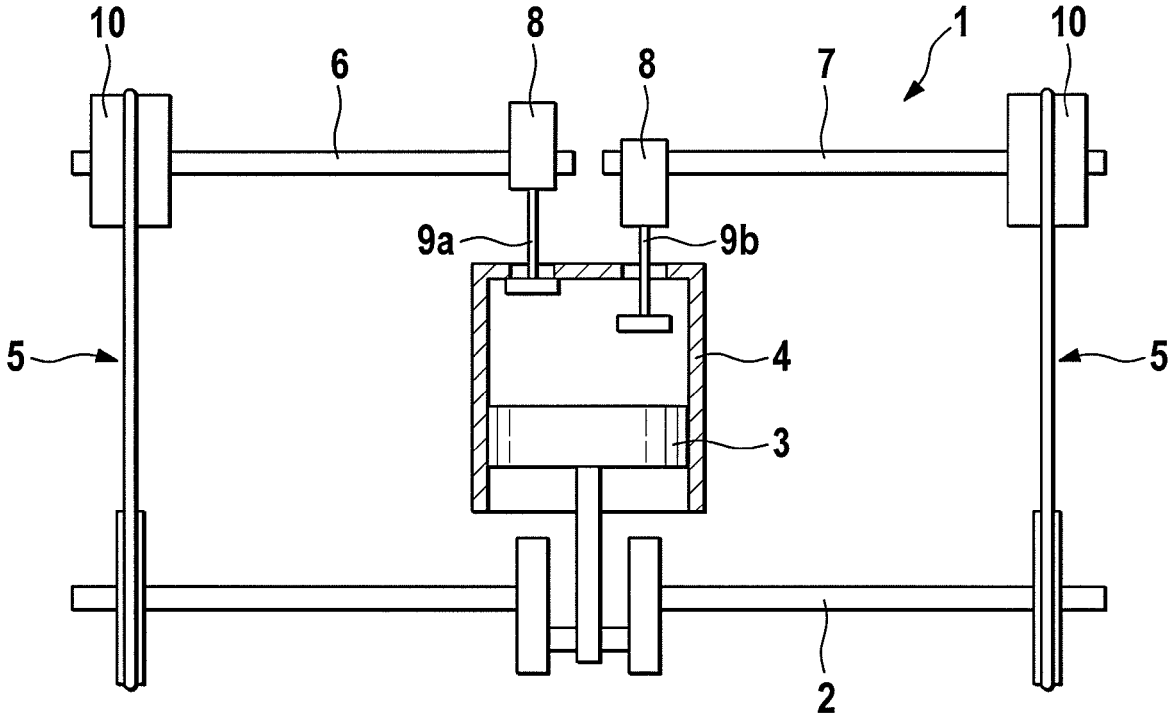
FIG. 1 is a view, only very schematically, of an internal combustion engine.

In FIG. 1, an internal combustion engine 1 is sketched, wherein a piston 3 sitting on a crankshaft 2 is indicated in a cylinder 4. The crankshaft 2 is connected, in the shown embodiment, by a traction mechanism drive 5 to an intake camshaft 6 or an exhaust camshaft 7, wherein a first and a second apparatus 10 can provide for relative rotation between the crankshaft 2 and the camshafts 6, 7. The cams 8 of the camshafts 6, 7 activate one or more intake gas-exchange valves 9*a* or one or more exhaust gas-exchange valves 9*b*. Similarly, it can be provided that only one of the camshafts 6, 7 is equipped with an apparatus 10 or only one camshaft 6, 7 is provided, which is provided with an apparatus 10.

Figure 2A:
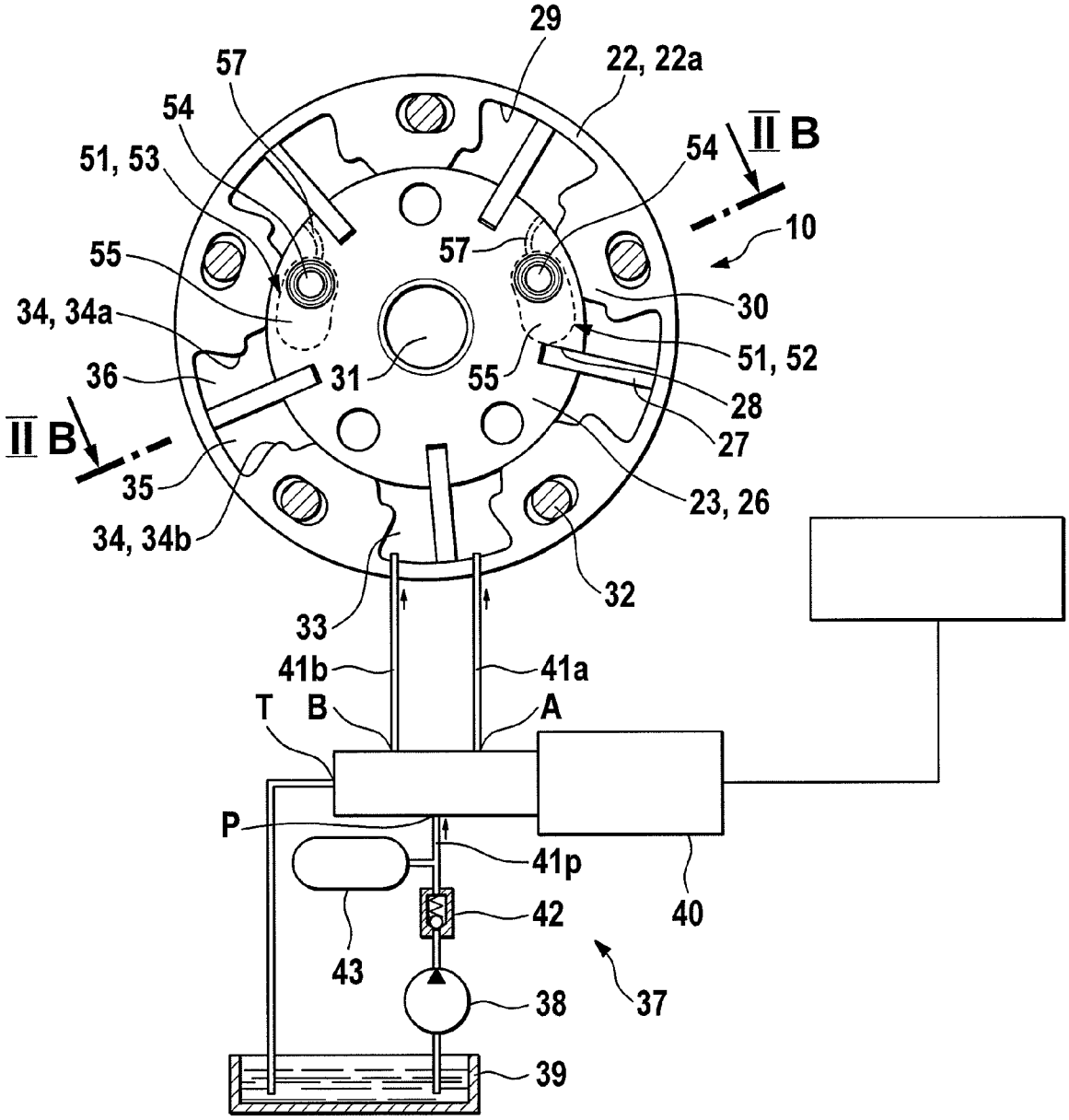
FIG. 2*a* is a top view of a first embodiment according to the invention of an apparatus for changing the control times of gas-exchange valves of an internal combustion engine, including a connected hydraulic circuit.
Figure 2B:
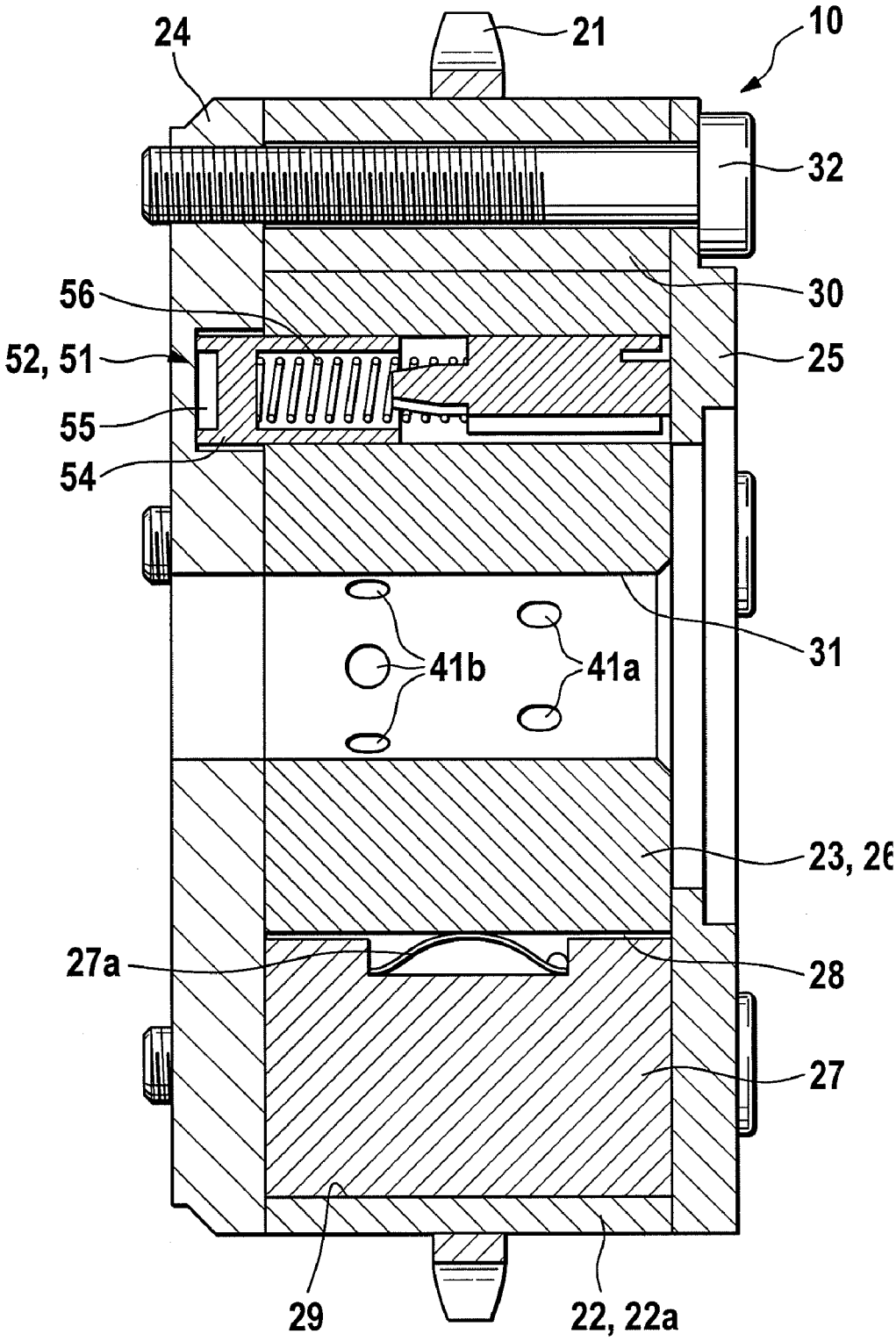
FIG. 2*b* is a longitudinal section view through the apparatus from FIG. 2*a* along the line IIB-IIB.

FIGS. 2*a* and 2*b* show a first embodiment of an apparatus 10 according to the invention in longitudinal section or in a lateral top view. The apparatus 10 has a drive element constructed as the outer rotor 22 and a driven element constructed as the inner rotor 23. The outer rotor 22 has a housing 22*a* and two side covers 24, 25, which are arranged on the axial side surfaces of the housing 22*a*. The inner rotor 23 is constructed in the form of a vane wheel and has an essentially cylindrical hub element 26, from whose outer cylindrical surface, in the illustrated embodiment, five vanes 27 extend outwardly in the radial direction. The vanes 27 are constructed separately from the inner rotor 23 and are arranged in vane grooves 28, which are constructed on the hub element 26. The vanes 27 are pressurized outward in the radial direction with a force by vane springs 27*a*, which are arranged between the groove bases of the vane grooves 28 and the vanes 27.

Starting from an outer peripheral wall 29 of the housing 22*a*, several projections 30 extend inward in the radial direction. In the shown embodiment, the projections 30 are constructed in one piece with the peripheral wall 29. The outer rotor 22 is supported on the inner rotor so that it can rotate relative to this inner rotor 23 via peripheral walls of the projections 30 on the inside in the radial direction.

On another surface of the peripheral wall 29, a chain wheel 21 is arranged, by which torque can be transmitted from the crankshaft 2 to the outer rotor 22 via a not-shown chain drive.

Each of the side covers 24, 25 is arranged on and locked in rotation with one of the axial side surfaces of the housing 22*a*. For this purpose, in each projection 30 there is an axial opening, which is passed through by an attachment element 32, for example, a screw, which is used for the rotationally locked fixing of the side cover 24, 25 on the housing 22*a*.

Within the apparatus 10, a pressure space 33 is formed between every two adjacent projections 30 in the peripheral direction. Each of the pressure spaces 33 is defined in the peripheral direction by opposite, essentially radial limiting walls 34 of adjacent projections 30, in the axial direction by the side covers 24, 25, radially inward by the hub element 26, and radially outward by the peripheral wall 29. A vane 27 projects into each of the pressure spaces 33, wherein the vanes 27 are constructed such that these contact both the side covers 24, 25 and also the peripheral wall 29. Each vane 27 thus divides each pressure space 33 into two counteracting pressure chambers 35, 36.

The inner rotor 23 can rotate in a defined angular range relative to the outer rotor 22. The angular range is limited in one rotational direction of the inner rotor 23 such that the vanes 27 each come in contact with a corresponding limiting wall 34 (advanced stop 34*a*) of the pressure spaces 33. Analogously, the angular range is limited in the other rotational direction such that the vanes 27 come in contact with the other limiting walls 34 of the pressure spaces 33, which are used as retarded stops 34*b*. Also conceivable are embodiments, in which only one or a few of the vanes 27 comes in contact with the end stops 34*a, b*. Alternatively, the rotational angle can be limited, for example, by a pin, which engages in a groove.

By pressurizing a group of pressure chambers 35, 36 and depressurizing the other group, the phase position of the outer rotor 22 relative to the inner rotor 23 can be varied. By pressurizing both groups of pressure chambers 35, 36, the phase position of the two rotors 22, 23 can be kept constant relative to each other. Alternatively, it can be provided that none of the pressure chambers 35, 36 are pressurized with pressurized medium during phases of constant phase position. As hydraulic pressurized medium, typically the lubricating oil of the internal combustion engine 1 is used.

For the supply of pressurized medium to or the discharge of pressurized medium from the pressure chambers 35, 36, a pressurized medium system 37 is provided, which comprises a pressurized medium pump 38, a tank 39, a control valve 40, and several pressurized medium lines 41*a, b, p*. The control valve 40 has a supply connection P, a tank connection T, and two work connections A, B. The first pressurized medium line 41*a* connects the first work connection A to the first pressure chambers 35. The second pressurized medium line 41*b* connects the second work connection B to the second pressure chambers 36. The third pressurized medium line 41*p* connects the pressurized medium pump 38 to the supply connection P. In the case of a control 40, which is arranged in the axial opening 31 of the apparatus 10, the pressurized medium lines 41*a, b* extend in the inner rotor 23. These can be constructed, for example, as boreholes or radial grooves in the axial side surfaces. In the case of control valves 40, which are held in a receptacle outside of the apparatus 10, for example, a cylinder head, the pressurized medium line 41*a, b* comprises additional hydraulic medium paths, which connect the control valve 40 to the boreholes or grooves constructed on the inner rotor 23.

Pressurized medium fed from the pressurized medium pump 38 is fed via the third pressurized medium line 41*p*, in which a non-return valve 42 is arranged, to the control valve 40. According to the control state of the control valve 40, the third pressurized medium line 41*p* is connected to the first pressurized medium line 41*a*, the second pressurized medium line 41*b*, or to both or none of the pressurized medium lines 41*a, b*.

In order to shift the control times (opening and closing times) of the gas-exchange valves 9*a*, 9*b* in the advanced direction, the pressurized medium fed to the control valve 40 via the third pressurized medium line 41*p* is fed via the first pressurized medium line 41*a* to the first pressure chambers 35. Simultaneously, pressurized medium is led from the second pressure chambers 36 via the second pressurized medium line 41*b* to the control valve 40 and is discharged into the tank 39. Therefore, the vanes 27 are shifted in the direction of the advanced stop 34*a*, by which a rotational movement of the inner rotor 23 relative to the outer rotor 22 in the rotational direction of the apparatus 10 is achieved.

In order to shift the control times of the gas-exchange valves 9*a*, 9*b* in the retarded direction, the pressurized medium fed to the control valve 40 via the third pressurized medium line 41*p* is led to the second pressure chambers 36 via the second pressurized medium line 41*b*. Simultaneously, the pressurized medium from the first pressure chambers 35 is led to the control valve 40 via the first pressurized medium line 41*a* and is discharged into the tank 39. Therefore, the vanes 27 are shifted in the direction of the retarded stop 34*b*, by which a rotational movement of the inner rotor 23 relative to the outer rotor 22 against the rotational direction of the apparatus 10 is achieved.

To keep the control times constant, the supply of pressurized medium to all of the pressure chambers 35, 36 is either stopped or permitted. Therefore, the vanes 27 within each pressure space 33 are fixed hydraulically and thus a rotational movement of the inner rotor 23 relative to the outer rotor 22 is prevented.

In the design of the pressurized medium pump 38, it must be taken into consideration that the provided pressure within the pressurized medium system 37 is sufficient in each operating state of the internal combustion engine 1 to guarantee a phase adjustment. Because the pressurized medium pump 38 is driven by the crankshaft 2, the provided pressure or the provided pressurized medium volume flow is dependent on the rotational speed of the internal combustion engine 1. Thus, the pressure relationships at low rotational speeds must be taken into account, primarily at idling of the internal combustion engine 1.

If, during an idling phase of the internal combustion engine 1, an adjustment of the phase position is arranged by its control device, then the pressurized medium volume provided by the pressurized medium pump 38 cannot be sufficient to perform this adjustment request at the desired adjustment speed. The start of an adjustment of the phase position between the inner rotor 23 and the outer rotor 22 leads to a pressure drop in the pressurized medium system 37 below the pressure that typically prevails at the idling rotational speed. Thus, the desired phase position cannot be set or cannot be set quickly enough and the output parameters of the internal combustion engine 1, such as the provided torque or raw emissions, become worse.

To prevent this result, the pressurized medium pump 38 must have larger dimensions, by which the space requirements, the costs, and the fuel consumption of the internal combustion engine 1 are increased. To reduce fuel consumption, regulated pressurized medium pumps 38 can be used, by which, however, the costs and the regulation complexity are further increased.

Figure 3A:
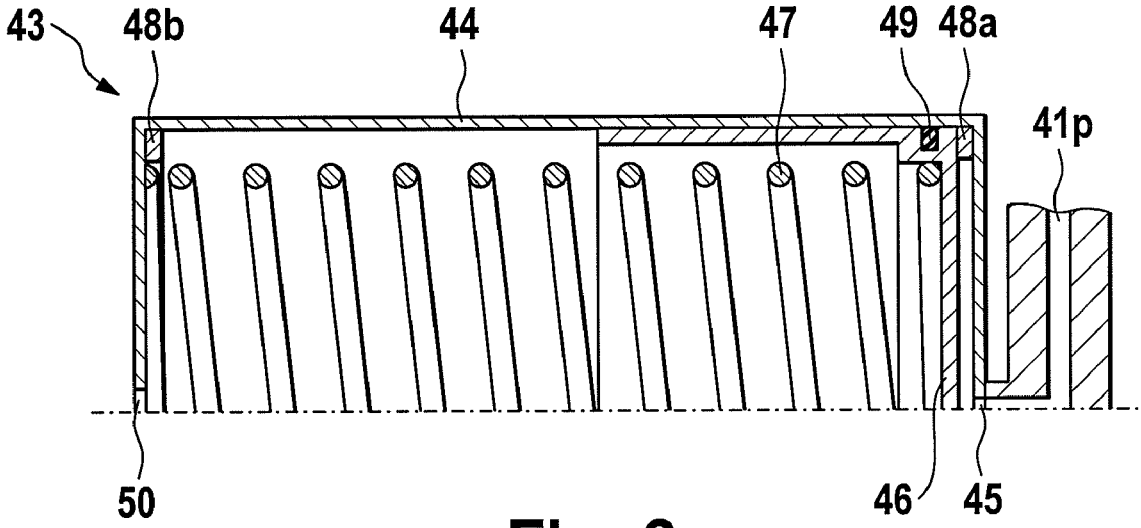
FIG. 3 is a longitudinal section view through a pressure storage device.
Figure 3B:
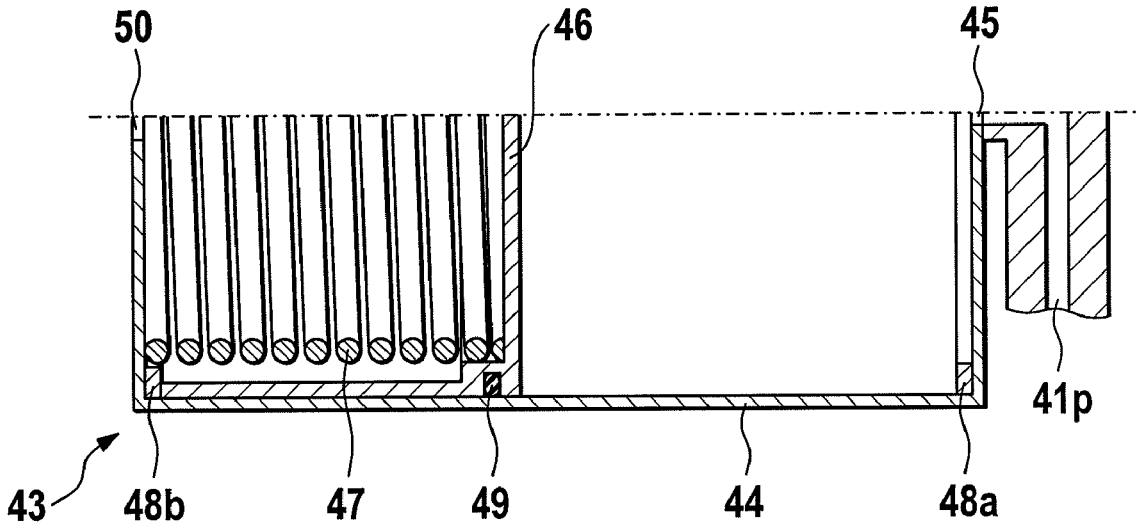

To avoid these disadvantages, a pressure storage device 43 is provided. In the illustrated embodiment, this storage device opens between the non-return valve 42 and the control valve 40 into the third pressurized medium line 41*p*. FIG. 3 shows a possible embodiment of a pressure storage device 43 in the form of a spring storage device. Also conceivable would be the use of other pressure storage devices 43, for example, piston, bubble, or membrane storage devices.

The pressure storage device 43 comprises a pressure container 44, which communicates via an opening 45 with the third pressurized medium line 41*p*. Within the pressure container 44 there is a pressure piston 46. A force, which pushes the pressurized medium out of the third pressurized medium line 41*p* against the pressure piston, acts on this pressure piston 46. This force pushes the pressure piston 46 within the pressure container 44 away from the opening 45. In addition, on the side of the pressure piston 46 away from the opening 45 there is a spring 47, which forces the pressure piston 46 in the direction of the opening 45. Here, the spring force increases with the distance of the pressure piston 46 to the opening 45. The pressure piston 46 can assume any position between two stops 48*a, b* as a function of the forces acting on this pressure piston.

In the illustrated embodiment, the pressure piston 46 has a pot-shaped construction, wherein, on a cylindrical outer surface, a sealing element 49 is arranged, which essentially prevents a pressurized medium flow between the front and the back of the pressure piston 46. Pressurized medium, which has nevertheless penetrated into the space of the spring 47, can be discharged into the tank 39 via a ventilation opening 50.

The spring 47 is installed in the pressure storage device 43 with biasing. Thus, the pressure piston 46 contacts the open-side (first) stop 48*a* in the depressurized state of the third pressurized medium line 41*p* (FIG. 3, top section). Due to the biasing of the spring 47, this state is maintained for increasing pressure until the pressure in the third pressurized medium line 41*p* exceeds a first pressure value (minimum response pressure), at which the pressure piston 46 has not yet lifted from the first stop 48*a*. If the pressure in the third pressurized medium line 41*b* exceeds the minimum response pressure of the pressure storage device 43, then the pressure piston 46 is shifted against the force of the spring 47 in the direction of the ventilation-side (second) stop 48*b*, wherein the pressure piston 46 comes in contact with the second stop 48*b* at a certain second pressure value (minimum fill pressure) (FIG. 3, bottom section). During the shifting of the pressure piston 46 from the first to the second stop 48*a, b*, the pressure storage device 43 is filled with pressurized medium. Here, the maximum fill volume of the pressure storage device 43 is the difference in volume of the pressurized medium in the pressure storage device 43 between the maximum and minimum distance of the pressure piston 46 from the first stop 48*a*. The spring force, which acts on the pressure piston 46, increase due to the excursion of the spring 47 with increasing shifting of the pressure piston 46 in the direction of the second end stop 48*b*.

The spring 47 and the surface of the pressure piston 46, on which the pressurized medium can act, are designed in such a way that the minimum fill pressure of the pressure storage device 43 lies below the pressure that prevails in the third pressurized medium line 41*p* at idling of the internal combustion engine 1, wherein it is adapted to the pressure that exists at the normal operating temperature of the internal combustion engine 1. Thus, the pressure storage device 43 is filled completely with pressurized medium during the idling phases of the internal combustion engine 1.

If an adjustment request is made to the apparatus 10 by the motor control device, then the pressure in the pressurized medium system 37 falls below the pressure, which typically prevails during the idling phase, until the minimum fill pressure of the pressure storage device 43 is reached. If this pressure value is reached, then the pressure storage device 43 provides the stored pressurized medium volume. The system pressure is kept constant or decreases slowly. Simultaneously, an additional pressurized medium volume, namely the fill volume of the pressure storage device 43, is made available to the pressurized medium system 37. Here, the non-return valve 42 prevents this volume from flowing back to the pressurized medium pump 38.

The optimum phase position of the inner rotor 23 relative to the outer rotor 22 is dependent, first, on the current rotational speed of the internal combustion engine 1 and, second, on the applied load. At each rotational speed of the internal combustion engine 1, the optimum phase position is located in an angular range, which is dependent on the current rotational speed. The optimum phase position within this range is determined by the applied load. Here, the ranges of phase positions, in which the optimum phase position lies at constant rotational speed, have different sizes and are shifted relative to each other for different rotational speeds. In addition, these ranges are smaller than the maximum adjustment range of the apparatus 10. To guarantee functionally reliable adjustment of the apparatus 10 at each time, it is provided that the fill volume of the pressure storage device 43 corresponds to the volume, which must be fed to the apparatus 10, in order to perform the greatest possible phase jump within the largest range at a constant rotational speed. The fill volume of the pressure storage device 43 must at least correspond to the volume that must be supplied to the apparatus 10, in order to perform the largest possible phase jump within the range that is valid for the idling rotational speed.

During start-up of the internal combustion engine 1, the system pressure increases with the rotational sped of the crankshaft 2. Thus, at the beginning there is not sufficient system pressure to guarantee the hydraulic fixing of the vanes 27 within the pressure spaces 33. To prevent uncontrolled oscillation of the inner rotor 23 relative to the outer rotor 22, a locking mechanism 51 is provided, which produces a mechanical connection between the two rotors 22, 23.

In the embodiment of the apparatus 10 shown in FIGS. 2*a*, 2*b*, the locking position is selected such that the vanes 27 are located in the locked state of the apparatus 10 in a position between the advanced stop 34*a* and the retarded stop 34*b*.

In this embodiment, the locking mechanism 51 is made from a first and a second rotational angle limiting device 52, 53. In the shown embodiment, each of the rotational angle limiting devices 52, 53 comprises an engagement element, which can shift in the axial direction and which is constructed as a pin 54 in the actual embodiment. Each of the pins 54 is held in a borehole of the inner rotor 23. In addition to pins 54, other engagement elements can also be used, for example, plates.

In addition, in the first side cover 24, two receptacles 55 are formed in the form of grooves extending in the peripheral direction. These are indicated in FIG. 2*a* in the form of broken lines. Each of the pins 54 is charged by means of a spring element 56 with a force in the direction of the first side cover 24. If the inner rotor 23 assumes a position relative to the outer rotor 22, in which a pin 54 is opposite the associated receptacle 55 in the axial direction, then this pin is forced into the receptacle 55 and each rotational angle limiting device 52, 54 is transferred from an unlocked state into a locked state. Here, the receptacle 55 of the first rotational angle limiting device 52 is constructed in such a way that the phase position of the inner rotor 23 relative to the outer rotor 22, for a locked first rotational angle limiting device 52, is limited to a region between a maximum advanced position and the locked position. If the inner rotor 23 relative to the outer rotor 22 is located in the locked position, then the pin 54 of the first rotational angle limiting device 52 contacts a stop formed by the receptacle 55 in the peripheral direction, by which further adjustment in the direction of retarded control times is prevented.

Analogously, the receptacle 55 of the second rotational angle limiting device 53 is designed in such a way that for a locked second rotational angle limiting device 53, the phase position of the inner rotor 23 relative to the outer rotor 22 is limited to a region between a maximum retarded position and the locked position. If both rotational angle limiting devices 52, 53 are in the locked state, then a rotationally fixed, mechanical coupling between the inner rotor 23 and the outer rotor 22 is created.

To transfer the rotational angle limiting devices 52, 53 from the locked state into the unlocked state, it is provided that each receptacle 55 is charged with pressurized medium. In this way, each pin 54 is forced back against the force of the spring element 56 in the borehole and thus the rotational angle limiting is canceled. In the illustrated embodiment, the receptacles 55 are connected by control lines 57 each to one of the pressure chambers 35, 36.

If the pressure in the pressurized medium system 37 lies below the pressure that is necessary to force the pins 54 back into the borehole, then there is a positive-fit connection between the inner rotor 23 and the outer rotor 22. In these operating phases, no adjustment is provided between the inner rotor 23 and the outer rotor 22, so that no additional pressurized medium volume is needed. Thus, the minimum response pressure of the pressure storage device 43 can be designed greater than the pressure that is necessary to transfer the rotational angle limiting devices 52, 53 into the unlocked state.

The invention can also be used in an embodiment, in which the rotational angle limiting devices 52, 53 are pressurized with pressurized medium via a separate control line, which does not communicate with the pressure chambers 35, 36, but which, instead, is connected directly to an additional control connection formed on the control valve 40.

Figure 4:
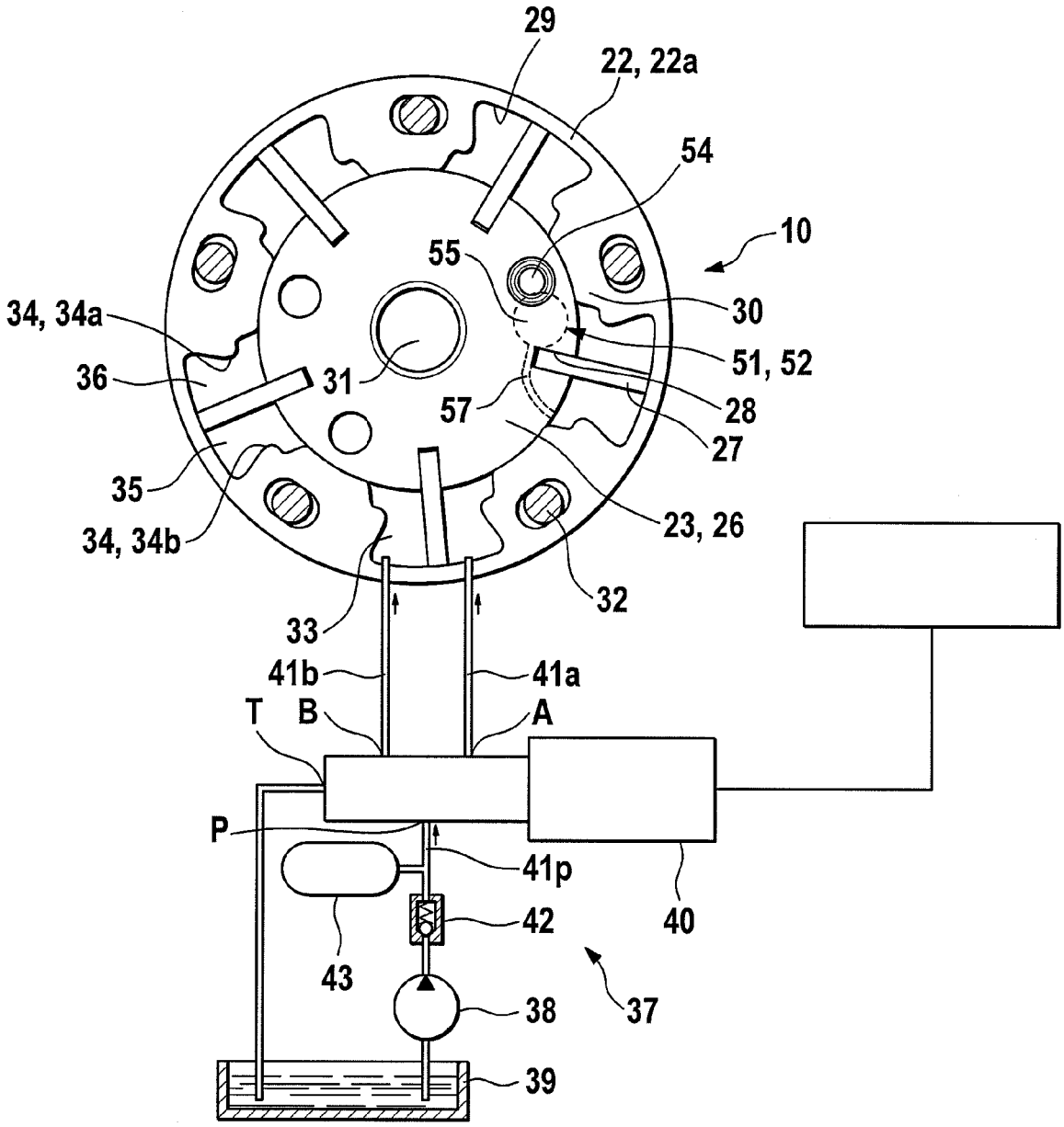
FIG. 4 is a top view of another embodiment according to the invention of an apparatus for changing the control times of gas-exchange valves of an internal combustion engine, including a connected hydraulic circuit.

FIG. 4 shows another embodiment of an apparatus 10. In contrast to the first two embodiments, here only one rotational angle limiting device 52 is provided, which can couple the inner rotor 23 with the outer rotor 22 in a defined phase position (preferably in the maximum advanced position and the maximum retarded position of the inner rotor 23 relative to the outer rotor 22, but middle positions are also conceivable). For this purpose, the receptacle 55 is constructed here not as a groove in the peripheral direction, but instead is adapted to the pin 54.

REFERENCE SYMBOLS

1 Internal combustion engine
2 Crankshaft
3 Piston
4 Cylinder
5 Traction mechanism drive
6 Inlet camshaft
7 Outlet camshaft
8 Cam
9*a* Intake gas-exchange valve
9*b* Exhaust gas-exchange valve
10 Apparatus
21 Chain wheel
22 Outer rotor
22*a* Housing
23 Inner rotor
24 Side cover
24 Side cover
26 Hub element
27 Vane
27*a* Vane springs
28 Vane grooves
29 Peripheral wall
30 Projection
31 Axial opening
32 Attachment element
33 Pressure space
34 Limiting wall
34*a* Advanced stop
34*b* Retarded stop
35 First pressure chamber
36 Second pressure chamber
37 Pressurized medium system
38 Pressurized medium pump
39 Tank
40 Control valve
41*a* First pressurized medium line
41*b* Second pressurized medium line
41*p* Third pressurized medium line
42 Non-return valve
43 Pressure storage device
44 Pressure container
45 Opening
46 Pressure piston
47 Spring
48*a* First stop
48*b* Second stop
49 Sealing element
50 Ventilation opening
51 Locking mechanism
52 Rotational angle limiting device
53 Rotational angle limiting device
54 Pin
55 Receptacle
56 Spring element
57 Control line
A First work connection
B Second work connection
P Supply connection
T Discharge connection

The invention claimed is:

1. An apparatus for the variable setting of control time of gas-exchange valves of an internal combustion engine, comprising a drive element, a driven element, at least one pressure chamber, a pressurized medium system, and a pressure storage device, the at least one pressure chamber and the pressure storage device communicate with the pressurized medium system, a phase position between the driven element and the drive element is changeable by supplying pressurized medium to or discharging pressurized medium from the at least one pressure chamber by the pressurized medium system, the pressure storage device has a minimum fill pressure that is less than a pressure within the pressurized medium system at an idling rotational speed of the internal combustion engine.

2. The apparatus according to claim 1, further comprising a rotational angle limiting device, which has a receptacle and at least one engagement element pressurized by force in a direction of the receptacle, the rotational angle limiting device, in a locked state, in which the engagement element engages in the receptacle, limits a phase position of the driven element relative to the drive element at least to an angular range, the rotational angle limiting device is transferable into an unlocked state through pressurization of the receptacle by pressurized medium, and a minimum response pressure of the pressure storage device is greater than a minimum response pressure of the rotational angle limiting device.

3. The apparatus (10) according to claim 1, wherein the pressurized medium system has a control valve, a pressurized medium pump, and several pressurized medium lines, the control valve has at least one supply connection and at least one work connection, a first one of the pressurized medium lines connects the work connection to the pressure chamber, another of the pressurized medium lines connects the pressurized medium pump to the supply connection, and the pressure storage device opens upstream of the control valve into the other pressurized medium line.

4. The apparatus according to claim 1, wherein a non-return valve, which permits, at a position thereof, only a pressurized medium flow in a direction of the opening position of the pressure storage device, is arranged in the pressurized medium system upstream of the position, at which the pressure storage device opens into the pressurized medium system.

5. The apparatus according to claim 1, wherein the pressure storage device is arranged within a camshaft.

6. The apparatus according to claim 1, wherein a volume of the pressure storage device corresponds at least to a volume that must be supplied to the apparatus, in order to allow an adjustment corresponding to a maximum permissible phase difference at a rotational speed.

7. The apparatus according to claim 1, wherein a minimum fill pressure of the pressure storage device is less than 1 bar.

8. The apparatus according to claim 1, wherein a minimum response pressure of the pressure storage device is greater than 0.3 bar.

* * * * *